United States Patent [19]

Rita

[11] Patent Number: 4,606,546

[45] Date of Patent: Aug. 19, 1986

[54] EDUCATIONAL GAME

[75] Inventor: William J. Rita, Springfield, Va.

[73] Assignee: Summer Afternoon, Inc., Springfield, Va.

[21] Appl. No.: 715,245

[22] Filed: Mar. 25, 1985

[51] Int. Cl.[4] ..... A63F 3/00

[52] U.S. Cl. ..... 273/269; 273/300

[58] Field of Search ..... 273/269, 270, 300, 302; 434/363

[56] References Cited

U.S. PATENT DOCUMENTS

| | | | |
|---|---|---|---|
| 1,061,999 | 5/1913 | Grondahl | 273/269 |
| 3,143,348 | 8/1964 | Carsen | 273/302 X |
| 3,545,101 | 12/1970 | Fike | 273/269 X |
| 4,306,725 | 12/1981 | Sawyer | 273/302 |
| 4,558,865 | 12/1985 | Isgar | 273/302 X |

OTHER PUBLICATIONS

Ideal Science Bingo Series, p. 187, of Cleo Learning Aids Catalog, Mar. 1976.

*Primary Examiner*—Harland S. Skogquist

*Attorney, Agent, or Firm*—Eric P. Schellin

[57] ABSTRACT

An educational game wherein each player is provided with an answer board having a series of answer sets each set having a plurality of answers. A plurality of cards are divided into a plurality of groups. Each card is provided with a question on one side and an answer on the other side. Each question is also provided with a location code that directs the player to an answer set on the answer board. By answering the question correctly the player may cover a portion of a game board with a marker. When the game board is covered by a single player, that player is declared the winner. A die is used to determine from which group of cards a card will be selected.

14 Claims, 5 Drawing Figures

FIG. 1
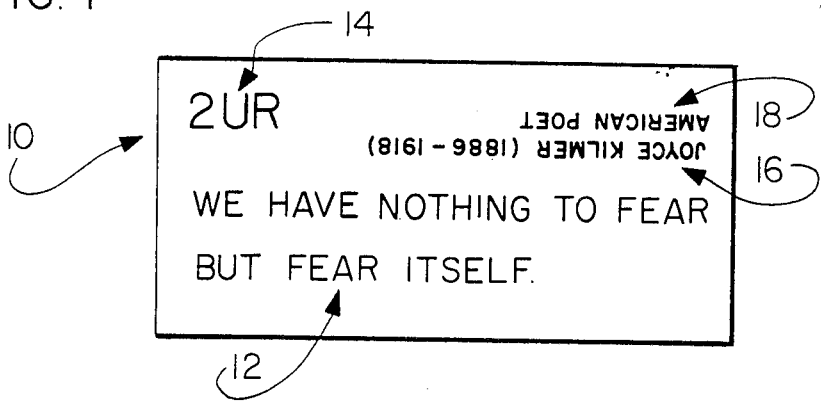
FIG. 2
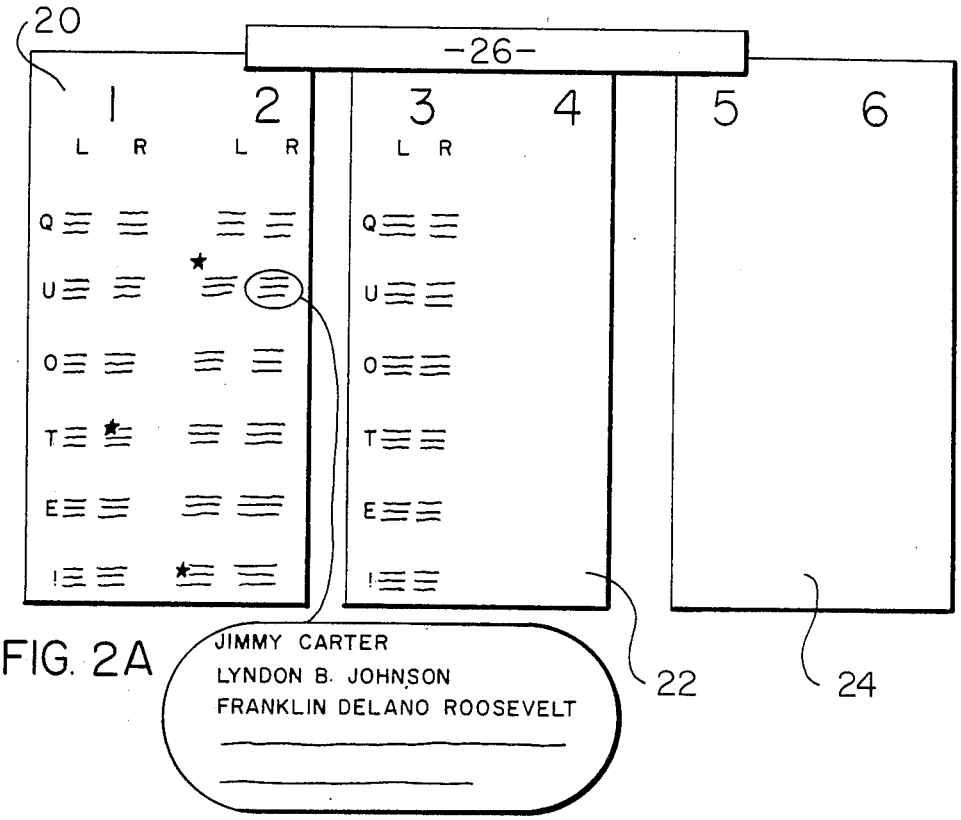
FIG. 2A

EDUCATIONAL GAME

BACKGROUND OF THE INVENTION

1. Field of the Invention:

The invention is related to a game, and specifically an educational game utilizing cards and answer boards for determining the advancement of a player in the game.

2. Description of the Prior Art:

Board games and card games have always been popular and have often been used to teach various principles for educational purposes, see U.S. Pat. Nos. 4,084,816, 4,109,918 and 4,306,725. Cards having questions and answers have been used to determine advancement of the player on the board. A popular game at present is called TRIVIAL PURSUIT, a registered trademark of Horn Abbot Ltd of Ontario, Canada. In this game a set of cards having questions on one side and answers on the other are used to question a player. A die determines the movement of a piece on a playing surface and the location of the piece determines which of the questions will be asked. By answering correctly the player is allowed to roll the die again until all the categories of questions have been answered.

Board games have also been proposed wherein the board itself is provided with indicia which are related to questions asked of a player, see U.S. Pat. No. 3,939,578. By using the indicia on the board a player must answer the posed question before advancing along the board.

The question cards themselves have may be encoded with all sorts of educational indicia, see U.S. Pat. Nos. 354,424, 807,433, 1,327,019, 1,600,108 and 3,143,348. Of particular interest are quotation cards, having a famous quote on one side and the author on the other side, that are disclosed in U.S. Pat. Nos. 958,258 and 1,263,664.

One problem associated with many of these games, is that if multiple answers are suggested to the player being questioned, the player must keep all the answers in his or her memory until selecting the right answer. This of course results in the questioned player asking the answers to be repeated resulting in tedium to the other players. In addition, it does not facilitate the other players to play along, because they too must keep the answer selections in their memory.

SUMMARY

It is the object of the present invention to provide an entertaining educational game in which all the players can play along with each question. As such each player is provided with an answer board having a set of answers for each question. The set of answers, from which the correct answer is to be selected, is apparent to all the players on each player's answer board, so that they may play along with the questioned player. In addition the questioned player does not have to ask for the answers to be repeated.

The game comprises a plurality of cards that are arranged in groups which correspond to specific groups of answer boards having multiple answers for each card in that group. The cards and boards are divided into numerical groups such as 1–2, 3–4 and 5–6 which correspond to the faces of a die. By rolling a die a player selects a card from the appropriate card group and reads the question to the questioned player who in turn refers to the answer board to select an answer.

Each group of cards is divided into subgroups, which corresponds to a particular answer board in the answer board group. Therefore, the answer boards are divided into subgroups that correspond to the breakdown of the question card. Each subgroup of answer boards and cards are color coded.

BRIEF DESCRIPTION OF THE DRAWINGS

FIG. 1, is a view of a playing card;

FIG. 2, is a view of the answer boards;

FIG. 2A, is a closeup view of one answer set;

DETAILED DESCRIPTION

Figure 3:
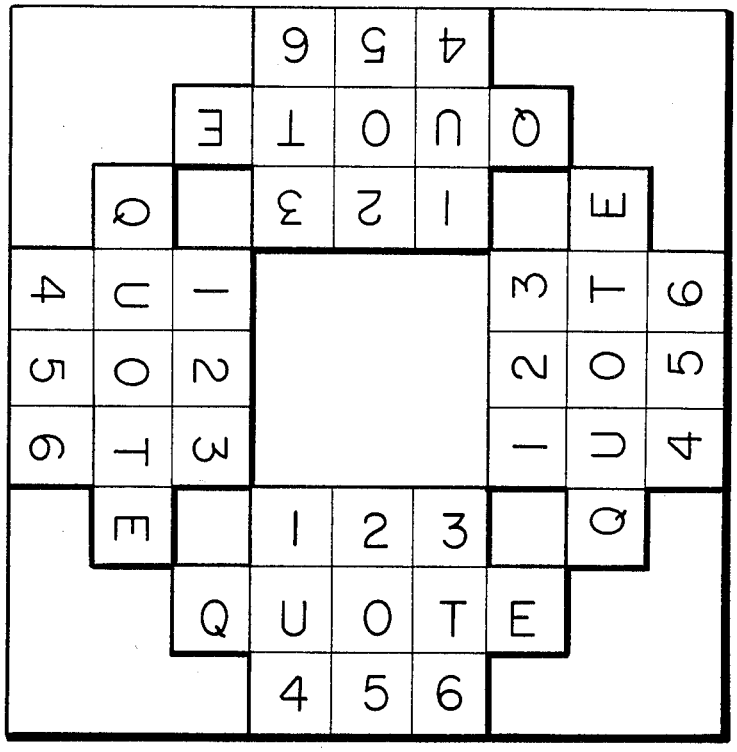
FIG. 3, is a view of the game board.

The present invention will be described as a quotation game, to which it is particularly adapted. However other questions and answers could be used in place of famous quotations and authors.

As seen in FIG. 1 one side of card 10 is provided with famous quote 12, location code 14 and answer 16. In addition, the card maybe provided with informative indicia 18. Answer 16 on this side of the card is the author of a famous quote that appears on the other side of the card. The answer for quote 12 may also be found on the other side of the card.

Answer boards 20, 22 and 24 are secured together by mounting means 26 that can be in the form of an elongated binder clip or other suitable apparatus. The answer boards themselves are each provided with sets of answers 21 that correspond to questions on the cards.

The answer sets are arranged in rows and columns on the answer boards, and each row and column can be identified by either a letter (horizontal rows), or a number (vertical columns) with left and right designations (L,R). On the illustrated boards there are 24 answer sets, each of which can be identified by the location code on the question card. For example, the card illustrated in FIG. 1 is encoded with location code "2UR" which identifies the answer set in vertical column 2, horizontal row U the righthand column. As seen in FIG. 2A the answer set comprises a list of presidents, the middle one forming the correct answer, that is Franklin Delano Roosevelt.

Figure 4:
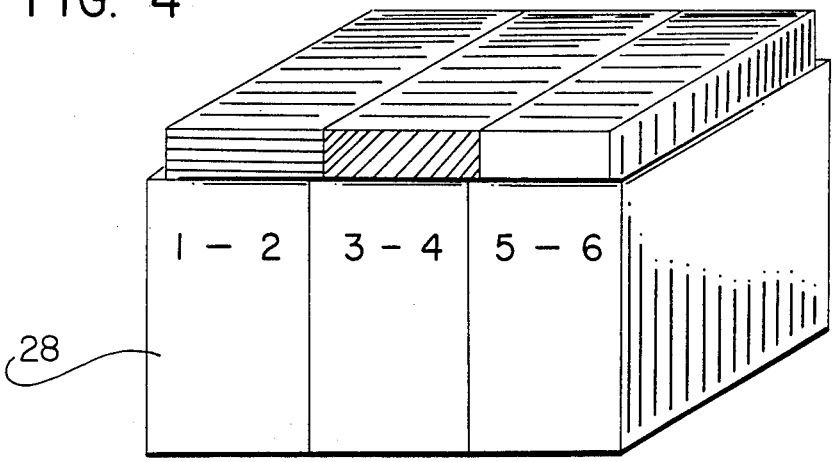
FIG. 4, is an (e) isometric view of multiple subgroups of cards.

As can be seen in FIG. 4, the groups of cards are placed in a box or receptacle 28 from which they can be easily accessed. The roll of a die determines from which group the player's card will selected and what side of the card shall be read. Another player then takes the selected card and first reads the location code and then the quote or question to the player who has just rolled the die. The questioned player then selects an answer from the set of answers provided on the answer board and announces his selection to the questioning player who rules if the player's answer is right or wrong.

It should be noted that the groups into which the cards and answer boards are broken are numerical groups dictated by the six surfaces of a die. More specifically the groups are 1–2, 3–4 and 5–6. If a player rolls a 1 or a 2 on the die, a card is selected from group 1–2. Depending if the number is 1 or 2 dictates from which side of the card the question is to be selected. For example if a 2 was rolled, and the card selected is the one illustrated in FIG. 2, quotation 12 would be read. If a 1 was rolled the quotation appearing on the other side would be read The playing board itself is illustrated in FIG. 3 and is divided into portions or grids which correspond to the numbers 1–6 which are the numbers on a die. In addition the board is provided with a word, in this instance "QUOTE". When a player answers a question correctly he or she may place a marker on one of the grids or portions. For convenience, each of the players is provided with individual sections of the board having the same indicia to be covered. When one player covers all of the grids or portions that player is declared the winner.

The player answering a question correctly may only cover a grid or portion corresponding to the number of the question group just answered, and/or the letter of the location code of the selected card. Both letter and number wildcards are provided which frees the player to select any number or any letter uncovered on the playing board. For example when a card is selected with a location code having an exclamation point (!), and the player answers correctly, the player may cover any letter on the playing board. Likewise if the location code directs the player to a starred answer set, the player, if answering correctly, may place his or her marker on any of the numbers uncovered on the board.

Each group of cards are divided into multiple color coded subgroups. For example Group 1–2 is divided into a blue, green and yellow subgroups of cards. At least a portion of each of the cards in each set is colored with the appropriate color. Each group of cards and each color set have individual color coded answer boards that must be used with each set.

To set up a game one subgroup of cards is selected from each of the three groups (1–2, 3–4, 5–6) and placed in box 28. Then the appropriate game boards are selected for each set of cards and mounted on the mounting means, as illustrated in FIG. 2. Each player has the same set of answer boards with the same answer sets.

To minimize the size and printing costs of the game, the answer boards are printed on both sides of a cardboard sheet. For a four player game set, 36 answer boards must be provided; where there are three groups each having three color coded subgroups. The 36 boards can be printed on only 18 sheets of cardboard by using the following arrangement:

| Number of | Side 1 | | Side 2 | |
|---|---|---|---|---|
| Boards | color | group | color | group |
| 2 | blue | 1-2 | green | 1-2 |
| 2 | blue | 1-2 | yellow | 1-2 |
| 2 | green | 1-2 | yellow | 1-2 |
| 2 | blue | 3-4 | green | 3-4 |
| 2 | blue | 3-4 | yellow | 3-4 |
| 2 | green | 3-4 | yellow | 3-4 |
| 2 | blue | 5-6 | green | 5-6 |
| 2 | blue | 5-6 | yellow | 5-6 |
| 2 | green | 5-6 | yellow | 5-6 |

By using three groups of answer boards and cards wherein each group has three sets, the boards and likewise cards can be arranged into 27 different combinations to change playing conditions during different games.

The subject game has been described with regards to a particular embodiment, but should not be so limited and should be limited solely by the claims that follow.

I claim:

1. A game for entertaining a number of players comprising:

a plurality of cards, the cards are divided into at least two card groups, each card is provided with at least one question on one side of the card, and at least one answer, corresponding to the question, on the other side of the card, the card is also provided with a location code for the question on the question side of the card;

a random group selection generating means for selecting from which group of cards a single card is to be selected;

a plurality of answer boards which are divided into at least two answer board groups, each answer board is provided with a series of answer sets comprising a plurality of answers, each answer set can be identified by the location code, whereby during play a player is provided with at least two answer boards that corresponds to at least two groups of cards being selected for play, when a card is selected from one of the groups of cards, as determined by the random group selection generating means, the location code determines the location of an answer set on the answer board for the selected group of cards, a player can then make the correct answer selection for the question from the answers in the located answer set.

2. A game as defined by claim 1 further comprising a game board having a number of identifiable portions, and groups of covering markers for each player, wherein upon correct answering of a question the player may cover a selected portion of the game board and when one player's markers covers all of the game board that player is declared a winner.

3. A game as defined by claim 2 further comprising a mounting means for joining at least two answer boards together for each player.

4. A game as defined by claim 3 wherein the random group selection generating means comprises at least one die.

5. A game as defined by claim 4 wherein each card is provided with at least two questions located on opposite sides of the card, and each question is provided with an answer which is located on a side of the card opposite from the appropriate question.

6. A game as defined by claim 5 wherein the cards are grouped into three groups and each group is further divided into two sections by the opposite sides of the card, whereby a roll of the die first determines the group from which the card is to be selected and second which side of the card a question is to be taken from.

7. A game as defined by claim 6 wherein the answer for the question on the card is provided with other informative indicia.

8. A game as defined by claim 7 wherein the questions are famous quotations and the answers famous authors of the quotations.

9. A game as defined by claim 8 wherein there are at least two subgroups for each group of cards and correspondingly for each group of answer boards.

10. A game as defined by claim 9 wherein the game is provided with three subgroups of cards for each group and at least three different answer boards for each group of cards corresponding to each subgroup of cards.

11. A game as defined by claim 10 wherein each card and each answer board is provided with coding means for identifying each subgroup to which an individual card and answer board belongs.

12. A game as defined by claim 11 wherein the coding means comprises a color code wherein at least a portion of each card and each answer board is colored with an identifying color.

13. A game as defined by claim 12 wherein the game board is divided into identical sections for each player.

14. A game as defined by claim 10 wherein the groups of cards and answer boards comprise three numerical groups each representing two sides of a six sided die.

* * * * *